United States Patent [19]

Greene

[11] Patent Number: 5,019,674

[45] Date of Patent: May 28, 1991

[54] WIRE SPLICER DEVICE

[76] Inventor: Lance W. Greene, 9930 University Ave., NW., Coon Rapids, Minn. 55433

[21] Appl. No.: 477,759

[22] Filed: Feb. 9, 1990

[51] Int. Cl.[5] ..... H01R 11/09

[52] U.S. Cl. ..... 174/84 R; 174/84 C; 174/84 S; 439/391; 439/426

[58] Field of Search ..... 174/84 R, 84 S, 84 C; 439/387, 391, 421, 426, 877, 882

[56] References Cited

U.S. PATENT DOCUMENTS

| | | | |
|---|---|---|---|
| 2,534,881 | 12/1950 | Schroeder | 174/84 S |
| 3,388,367 | 6/1968 | Brown | 439/223 |
| 4,199,211 | 4/1980 | Kidder | 439/406 |
| 4,268,104 | 5/1981 | Kidder | 439/164 |
| 4,508,409 | 4/1985 | Cherry et al. | 439/391 |

*Primary Examiner*—Morris H. Nimmo

[57] ABSTRACT

A wire splicer device for connecting electrical conductors includes a flexible sleeve formed of a non-conductive material and having a pair of openings therein. A pair of elongate arms are integrally connected with the exterior surface of the sleeve adjacent one end thereof and extend longitudinally towards the other end of the sleeve. The free end of each arm has a pressure element extending therefrom towards one of the openings in the sleeve. An elongate rigid electrically conductive splicing member is positioned within the sleeve and includes end elements, each having penetrating teeth struck therefrom. The teeth on the splicing member penetrate the insulation on the conductors to thereby electrically connect the conductors together and lock the conductors in the sleeve.

11 Claims, 1 Drawing Sheet

WIRE SPLICER DEVICE

FIELD OF THE INVENTION

This invention relates to a device for connecting or splicing electrical conductors.

BACKGROUND OF THE INVENTION

Electricians and mechanics are often required to splice electrical conductors together which are located in confined places. It is difficult, at best, to splice or interconnect wires in confined locations. Although crimping tools are used in splicing together electrical conductors, wire connector devices have been developed which do not require such tools.

U.S. Pat. No. 3,388,367 discloses an electrical connector device, which includes a U-shaped contact element formed of conductive material and having piercing teeth. The contact element is positioned within a passage of a block of dielectric material, which is provided with openings for accommodating rods that permit a user to compress the electrical conductors against the pierced teeth.

The Kidder Patent, U.S. Pat. No. 4,268,104, also discloses a wire connector including a sleeve or tube formed of non-conductive material, but having an electrically conductive metal strap extending longitudinally within the tube. Opposite end portions of the strap are provided with teeth, and the tube itself is shaped to form a pair of cams located at each end thereof. When this connector is used to splice electrical conductors, the connector is first bent into angled configuration and the wires are thereafter inserted into the tube. Thereafter, the tube is straightened and the cam portions cause the teeth to penetrate the wire and establish electrical connection therebetween.

The Kidder Patent, U.S. Pat. No. 4,199,211, also discloses a wire connector, which includes a metal tube covered with insulating material and having a pair of wire gripping members mounted in the tube adjacent opposite ends thereof. These wire gripping members are of flat configuration and cooperate with a camming member to guide the wires into proper position. The gripping members penetrate the insulation of the wires and effectively splice the wires together.

SUMMARY OF THE INVENTION

It is an object of this invention to provide a novel and improved wire splicer device, of simple and inexpensive construction, which is effective in quickly and easily connecting together electrical conductors located in confined areas.

Another object of this invention is to provide a novel and improved wire connecting device for connecting electrical conductors together by the application of finger pressure to the device.

In carrying out the invention, an outer flexible sleeve formed of a non-conductive material is provided and has a pair of arms integrally formed therewith. The free end of each arm is provided with a pressure element which may be urged through an opening in the sleeve. A splicer element formed of electrically conductive material is positioned within the sleeve and is provided with teeth for penetrating the insulation of the wire when the pressure elements are pressed through the openings in the sleeve.

These and other objects will be more fully defined in the following Specification.

FIGURES OF THE DRAWING

DESCRIPTION OF THE PREFERRED EMBODIMENT

Figure 1:
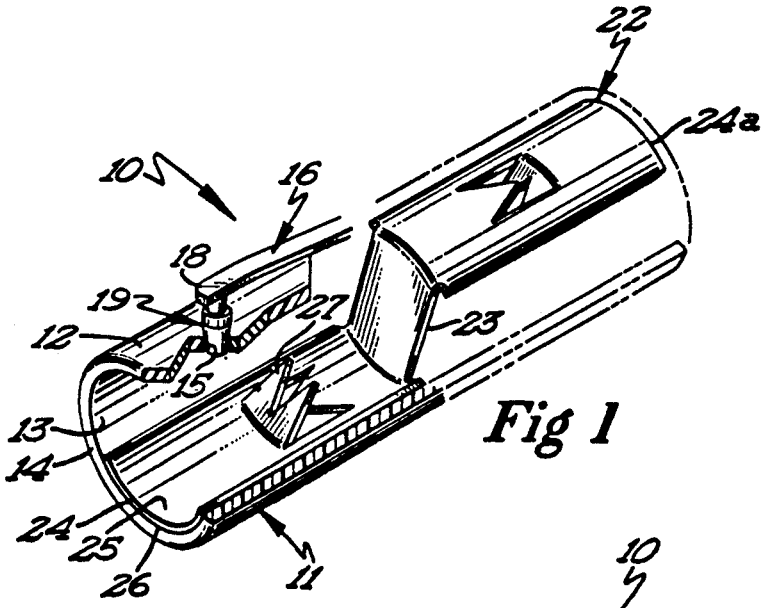
FIG. 1 is a perspective view of the novel wire splicer device, with certain parts thereof broken away for clarity.
Figure 2:
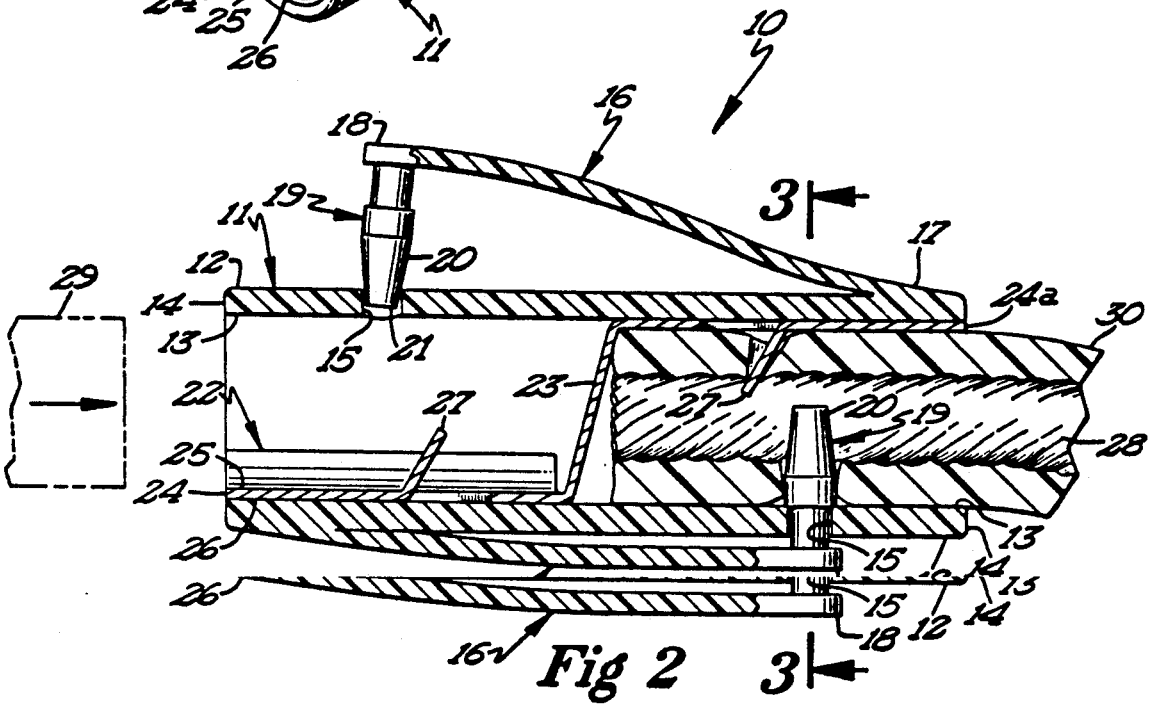
FIG. 2 is a cross-sectional view taken approximately along the line 2—2 of FIG. 1 and looking in the direction of the arrows.
Figure 3:
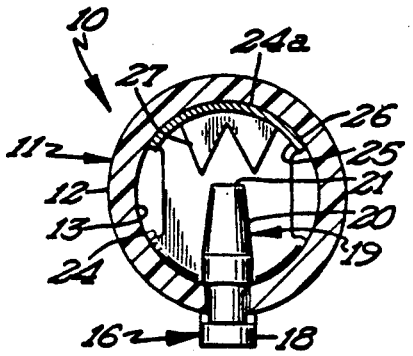
FIG. 3 is a cross-sectional view taken approximately along the line 3—3 of FIG. 2 and looking in the direction of the arrows.

Referring now to the drawings and, more specifically, to FIG. 1, it will be seen that one embodiment of the novel wire splicer device, designated generally by the reference numeral 10, is thereshown. The wire splicer device 10 includes an elongate cylindrical sleeve formed of a suitable dielectric flexible material, such as polyethylene, polypropylene, or the like. The sleeve 11 has an outer circumferential surface 12 and an inner circumferential surface 13 and circumferential end edges 14. The sleeve 11 is also provided with a pair of longitudinally spaced apart openings 15 therein. It will be noted that these openings are located on opposite sides of the sleeve.

The sleeve 11 is provided with a pair of elongate arms 16, each having one end 17 integrally formed with the outer surface 12 of the sleeve adjacent one end of the latter. In the embodiment shown, the attached end 17 for one arm 16 is located adjacent one end, while the attached end 17 of the other arm is located adjacent the other end of the sleeve. It will further be noted that the arms 16 are located on opposite sides or surfaces of the sleeve 11 and that the arms extend longitudinally towards each other. Therefore, the outer or free end 18 of each arm is located adjacent one end of the sleeve.

It will also be noted that each arm 16 has a pressure element 19 integrally formed therewith and projecting at substantially right angles from the free end 18 thereof. Each pressure element 19 is positioned adjacent one of the openings 15 in the sleeve 11, and each pressure element has a tapered frustro-conical portion 20 that terminates in a flat end 21. It will be seen that, when the user compresses the arms and the sleeve, the pressure elements 19 will be urged through the openings 15.

The splicer device 10 also includes an elongate rigid splicer member 22, which is formed of a conductive metal, and which is inserted through the sleeve 11. In this regard, the splicing member 22 has a length corresponding to the length of the sleeve 11, but is slightly shorter than the length of the sleeve so that the splicing member is completely contained within the sleeve. It is further pointed out that the sleeve 11 in typical applications will have a length dimension of approximately two inches.

The splicing member 22 includes a central element 23, which is integral with an end element 24 and end element **24*a*. The central element 23 is angularly disposed with respect to the end elements 24 and 24*a*, the latter being disposed in substantial parallel relation to each other. It is pointed out that the central element 23 is of flat configuration and has a width dimension slightly less than the width dimension of end elements 24, 24*a***.

The end elements 24, 24*a* are arcuate in cross-sectional shape, each having a concave surface 25 and a convex surface 26. It will be noted that the concave surface of the end element 24 faces in the opposite direction of the concave surface 25 of the end element 24*a*. It will further be noted that the convex surface 26 of each end element is positioned so that it engages the inner surface 13 of the sleeve 11. In this regard, the convex surface 26 for each end element is shaped and sized so that it is disposed in concentric relation with respect to the inner surface 13 of the cylindrical sleeve 11.

Each of the end elements has a pair of teeth projecting transversely and angularly therefrom from the concave surface thereof intermediate the ends of the end element. It will be noted that the teeth 27 on these end elements converge or project generally towards each other and in a direction away from the outer end of the associated end elements. In the embodiment shown, the included angle between the plane of the teeth for each end element and a plane disposed substantially normal to each end element is within the range of 25 degrees to 35 degrees. Although the angle of the teeth may vary within a range of 25 to 35 degrees, it is preferred that the angle be approximately 30 degrees, as illustrated in the drawings. The angle defined by the general plane of the angularly disposed central element 23 and a plane extending substantially normal to the splicing member 22 is approximately 15 degrees.

In use, electric conductors 28 and 29 will be inserted into the sleeve past the teeth 27 of each end element of the splicing member. The user will then manually apply pressure to the arms 16, thereby urging the pressure elements 19 through the openings 15, which compress the electrical conductors into the teeth 27. The teeth 27 will penetrate the insulating covering 30 of the conductors and engage the conductors so that electrical contact is established between the conductors by the splicing member 22. The user may then exert a slight pull on each of the conductors to make sure that the conductors are locked into the sleeve by the splicing member. The angled relation of the teeth lock the conductors in the sleeve.

Since the sleeve itself is flexible, only a modest amount of finger pressure is needed to splice electrical conductors with my device. No tools are needed for splicing the conductors together with my novel wire splicer device, and the connection may be accomplished in confined areas.

From the foregoing, it will be seen that I have provided a novel and improved wire splicer device, which is effective in permitting a user to quickly splice electrical conductors together in confined spaces, thereby improving maintenance and repair capabilities of various kinds of machines and apparatuses.

Thus, it will be seen that I have provided a novel wire splicer device which is not only of simple and inexpensive construction, but one which functions in a more efficient manner than any heretofore known comparable device.

What is claimed is:

1. A splicer device for splicing a pair of electrical conductors comprising:

a cylindrical sleeve formed of flexible non-conductive material and having a pair of longitudinally spaced apart openings therein, a pair of elongate arms, each having one end thereof integral with the exterior surface of said sleeve and terminating in a free end disposed adjacent one of said openings, each arm having a pressure element extending angularly from the free end thereof towards one of said openings in the sleeve, and an elongate single-piece splicing member positioned within said sleeve and being formed of an electrically conductive material, said splicing member including a central element and a pair of end elements integral with said central element, said central element being offset with respect to said end elements, each end element having teeth struck therefrom located adjacent one of said openings in the sleeve whereby, when the end portions of insulation covered electrical conductors to be spliced are positioned within the sleeve, and the arms are compressed by finger pressure of a user, the compression elements on said arms will cause said teeth to penetrate the insulation of the electrical conductors and clamp the end portions of the electrical conductors in electrically connected relation with said splicing member.

2. The splicer device as defined in claim 1 wherein the openings are each located adjacent one end of said sleeve and on opposite sides of the latter.

3. The splicer device as defined in claim 2 wherein the attached end of each arm is located adjacent one end of said sleeve and the free end of each arm is disposed adjacent the other end of said sleeve.

4. The splicer device as defined in claim 3 wherein said arms are located on opposite sides of said sleeve.

5. The splicer device as defined in claim 4 wherein said arms extend toward each other.

6. The splicer device as defined in claim 1 wherein said end elements of said splicing member are disposed in substantially parallel relation with respect to each other.

7. The splicer device as defined in claim 6 wherein said central element of the splicing member is angularly disposed with respect to said end elements.

8. The splicer device as defined in claim 7 wherein said teeth on the end elements of said splicing member extend in angularly converging relation with respect to each other.

9. The splicer device as defined in claim 7 wherein said end elements are arcuate in cross-section and engage the inner surface of said sleeve.

10. The splicer device as defined in claim 8 wherein the included angle between the plane of the teeth of said end element and a plane extending substantially normal to the end element is within the range of 25 degrees to 35 degrees.

11. A splicer device for splicing a pair of electrical conductors comprising:

an outer cylindrical sleeve formed of flexible non-conductive material and having a pair of longitudinally spaced apart openings therein, said openings being located on opposite sides of said sleeve, a pair of elongate arms, each having one end thereof integral with the exterior surface of said sleeve adjacent one end thereof and extending towards the other end of said sleeve, said arms being disposed on opposite sides of said sleeve and extending in opposite directions with respect to each other, each arm having a pressure element extending angularly from the outer end thereof towards one of said openings in the sleeve, and an elongate single-piece splicing member positioned within said sleeve and being formed of an electrically conductive material, said splicing member including a central element and a pair of end elements integral with said central element, said central element being angularly disposed with respect to said end elements, each end element having teeth struck angularly therefrom, the teeth in one end element converging angularly towards the teeth in the other end element, each end element engaging the inner surface of said sleeve with said teeth on each end element being located adjacent one of said openings in the sleeve whereby, when the end portions of insulation covered electrical conductors to be spliced are positioned within the sleeve, and the sleeve and arms are compressed by finger pressure of a user, the compression elements on said arms will cause said teeth to penetrate the insulation of the electrical conductors and clamp the end portions of the electrical conductors in electrically connected relation with said splicing member.

* * * * *